US009336706B2

(12) United States Patent
Kim

(10) Patent No.: US 9,336,706 B2
(45) Date of Patent: May 10, 2016

(54) ORGANIC LIGHT-EMITTING DIODE (OLED) DISPLAY AND METHOD FOR DRIVING THE SAME

(71) Applicant: Samsung Display Co., Ltd., Yongin-si, Gyeonggi-do (KR)

(72) Inventor: Kyung-Man Kim, Yongin-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 53 days.

(21) Appl. No.: 14/223,755

(22) Filed: Mar. 24, 2014

(65) Prior Publication Data

US 2015/0042688 A1 Feb. 12, 2015

(30) Foreign Application Priority Data

Aug. 12, 2013 (KR) ..... 10-2013-0095268

(51) Int. Cl.
*G09G 3/32* (2006.01)

(52) U.S. Cl.
CPC ..... *G09G 3/3208* (2013.01); *G09G 2320/0233* (2013.01); *G09G 2320/043* (2013.01); *G09G 2360/147* (2013.01)

(58) Field of Classification Search
None
See application file for complete search history.

(56) References Cited

U.S. PATENT DOCUMENTS

| | | | | |
|---|---|---|---|---|
| 8,130,182 | B2 * | 3/2012 | Levey et al. | 345/78 |
| 2005/0179625 | A1 | 8/2005 | Choi et al. | |
| 2005/0206592 | A1 | 9/2005 | Amano | |
| 2005/0237318 | A1 | 10/2005 | Inoue et al. | |
| 2005/0280766 | A1 | 12/2005 | Johnson et al. | |
| 2006/0071886 | A1 | 4/2006 | Johnson et al. | |
| 2006/0273997 | A1 | 12/2006 | Nathan et al. | |
| 2007/0132895 | A1 | 6/2007 | Shen | |
| 2010/0118002 | A1 | 5/2010 | Yamashita et al. | |
| 2010/0123740 | A1 | 5/2010 | Inoue et al. | |
| 2011/0007102 | A1 | 1/2011 | Ogura et al. | |
| 2011/0050674 | A1 | 3/2011 | Kim | |
| 2011/0069061 | A1 | 3/2011 | Nakamura | |
| 2011/0074750 | A1 * | 3/2011 | Leon et al. | 345/207 |
| 2011/0279436 | A1 | 11/2011 | Komiya et al. | |
| 2012/0169704 | A1 | 7/2012 | Chung | |

FOREIGN PATENT DOCUMENTS

| | | | |
|---|---|---|---|
| JP | 2005-301234 | | 10/2005 |
| JP | 2005-316408 | | 11/2005 |
| JP | 2011-65048 | A | 3/2011 |
| KR | 10-2003-0041855 | A | 5/2003 |
| KR | 10-2005-0043960 | | 5/2005 |
| KR | 10-2005-0071337 | | 7/2005 |
| KR | 10-2005-0085039 | | 8/2005 |
| KR | 10-2007-0035530 | | 3/2007 |

(Continued)

*Primary Examiner* — Joseph Haley
(74) *Attorney, Agent, or Firm* — Knobbe, Martens, Olson & Bear, LLP

(57) ABSTRACT

An organic light-emitting diode (OLED) display is disclosed. In one aspect, the OLED display includes a plurality of pixels, a luminance measuring unit, a current measuring unit, and a compensation data generator. The luminance measuring unit measures the luminance of each pixel and generates luminance information corresponding to the measured luminances. The current measuring unit measures the current output from each pixel and generates current information corresponding to the measured currents. The compensation data generator generates compensation data including a compensation value for each pixel based on the luminance information and/or the current information.

19 Claims, 4 Drawing Sheets

(56) References Cited

FOREIGN PATENT DOCUMENTS

| | | |
|---|---|---|
| KR | 10-2008-0007254 | 1/2008 |
| KR | 10-2008-0020454 | 3/2008 |
| KR | 10-2010-0015772 | 2/2010 |
| KR | 10-2010-0051569 | 5/2010 |
| KR | 10-2011-0005658 A | 1/2011 |
| KR | 10-2011-0024099 | 3/2011 |
| KR | 10-2011-0124655 | 11/2011 |
| KR | 10-2012-0079364 | 7/2012 |
| WO | WO 2006/005033 | 1/2006 |

* cited by examiner

ORGANIC LIGHT-EMITTING DIODE (OLED) DISPLAY AND METHOD FOR DRIVING THE SAME

CROSS-REFERENCE TO RELATED APPLICATIONS

This application claims priority to and the benefit of Korean Patent Application No. 10-2013-0095268, filed on Aug. 12, 2013, in the Korean Intellectual Property Office, the entire contents of which are incorporated herein by reference in their entirety.

BACKGROUND

1. Field

The described technology generally relates to an organic light-emitting diode (OLED) display and a method for driving the same.

2. Description of the Related Technology

Recently, various types of flat panel displays having reduced weight and volume when compared to cathode ray tube displays have been developed. Examples of flat panel display types include liquid crystal displays (LCDs), field emission displays, plasma display panels (PDPs), organic light-emitting diode (OLED) displays, and the like.

OLED displays can display images using OLEDs which emit light through the recombination of electrons and holes. OLED displays also have favorable characteristics such as fast response speeds and low power consumption. In a typical OLED display, each pixel includes a driving transistor which supplies current with an amplitude corresponding to a data signal so that light is generated in an OLED of the pixel.

SUMMARY OF CERTAIN INVENTIVE ASPECTS

One inventive aspect is an OLED display including a luminance measuring unit configured to measure luminance of each pixel and generate luminance information corresponding to the measured luminances, a current measuring unit configured to measure current output from each pixel and generate current information corresponding to the measured currents, and a compensation data generating unit configured to generate compensation data including a compensation value for each pixel, based on at least one of the luminance information or the current information.

The compensation data generating unit may generate the compensation data based at least in part on the luminance information when a gray scale of data supplied to a corresponding pixel is less than a first predetermined reference value. The compensation data generating unit may generate the compensation data based at least in part on the current information when the gray scale is greater than the first predetermined reference value.

The compensation data generating unit may generate the compensation data based at least in part on the luminance information and the current information when the gray scale is greater than the first predetermined reference value and less than a second predetermined value. The compensation data generating unit may generate the compensation data based at least in part on the current information when the gray scale is greater than the second predetermined reference value.

The compensation data generating unit may generate the compensation data based at least in part on the average value of the luminance information and the current information when the gray scale is greater than the first predetermined reference value and less than the second predetermined reference value.

The compensation data generating unit may include a first compensation data generating unit configured to generate a first compensation data according to the luminance information, a second compensation data generating unit configured to generate a second compensation data according to the current information, and a compensation data combining unit configured to combine the first and second compensation data according to the gray scale of the data supplied to a corresponding pixel, and output the combined data as the compensation data.

The current may be output from a driving transistor of each pixel.

The OLED display may further include a timing controller configured to convert first data subsequently supplied from an external source to a second data based on the compensation data.

The OLED display may further include a data driver configured to supply data signals corresponding to the second data received from the timing controller to the pixels through data lines.

Another aspect is a method for driving an OLED display, the method including applying a data signal to a pixel, generating luminance information by measuring luminance of the pixel, generating current information by measuring current output from the pixel, and generating compensation data for the pixel based on at least one of the luminance information and the current information.

The generating of the compensation data may include comparing the gray scale of the data signal with a reference gray scale, generating the compensation data based on the luminance information when the gray scale of the currently supplied data is less than the reference gray scale, and generating the compensation data based on the current information when the gray scale is greater than the reference gray scale.

The generating of the compensation data may include comparing the gray scale of the data signal with a first reference gray scale and a second reference gray scale, generating the compensation data based on the luminance information when the gray scale is less than the first reference gray scale, generating the compensation data based on the average value of the luminance information and the current information when the gray scale is greater than the first reference gray scale and less than the second reference gray scale, and generating the compensation data based on the current information when the gray scale is greater than the second reference gray scale.

The method may further include converting a next data signal based on the compensation data and supplying the converted data signal to the pixel.

Another aspect is an organic light-emitting diode (OLED) display including a timing controller configured to receive first data and output second data, a plurality of pixels, wherein each of the pixels is configured to be driven at a current and display light having a luminance based at least in part on the second data, and a compensation data generator configured to generate compensation data based on at least one of the current or the luminance of each pixel, wherein the timing controller is further configured to generate the second data based at least in part on the first data and the compensation data.

The OLED display may further include a luminance measuring unit configured to measure and provide the luminance of each pixel to the compensation data generator and a current measuring unit configured to measure and provide current output from each pixel to the compensation data generator. The compensation data generator may be further configured to generate the compensation data based on i) the measured luminance when a gray scale of data supplied to a corresponding pixel is less than a first predetermined reference value and ii) the measured current when the gray scale is greater than the first predetermined reference value.

The compensation data generator may be further configured to generate the compensation data based on i) the measured luminance and the measured current when the gray scale is between the first predetermined reference value and a second predetermined value and ii) the measured current when the gray scale is greater than the second predetermined reference value. The compensation data generator may be further configured to generate the compensation data based on the average value of the measured luminance and the measured current when the gray scale is between the first predetermined reference value and the second predetermined reference value.

The compensation data generator may include a first compensation data generator configured to generate first compensation data based at least in part on the measured luminance, a second compensation data generator configured to generate second compensation data based at least in part on the measured current, and a compensation data combining unit configured to: i) combine the first and second compensation data based at least in part on a gray scale of data supplied to a corresponding pixel and ii) output the combined data as the compensation data.

DETAILED DESCRIPTION OF CERTAIN INVENTIVE EMBODIMENTS

Figure 1:
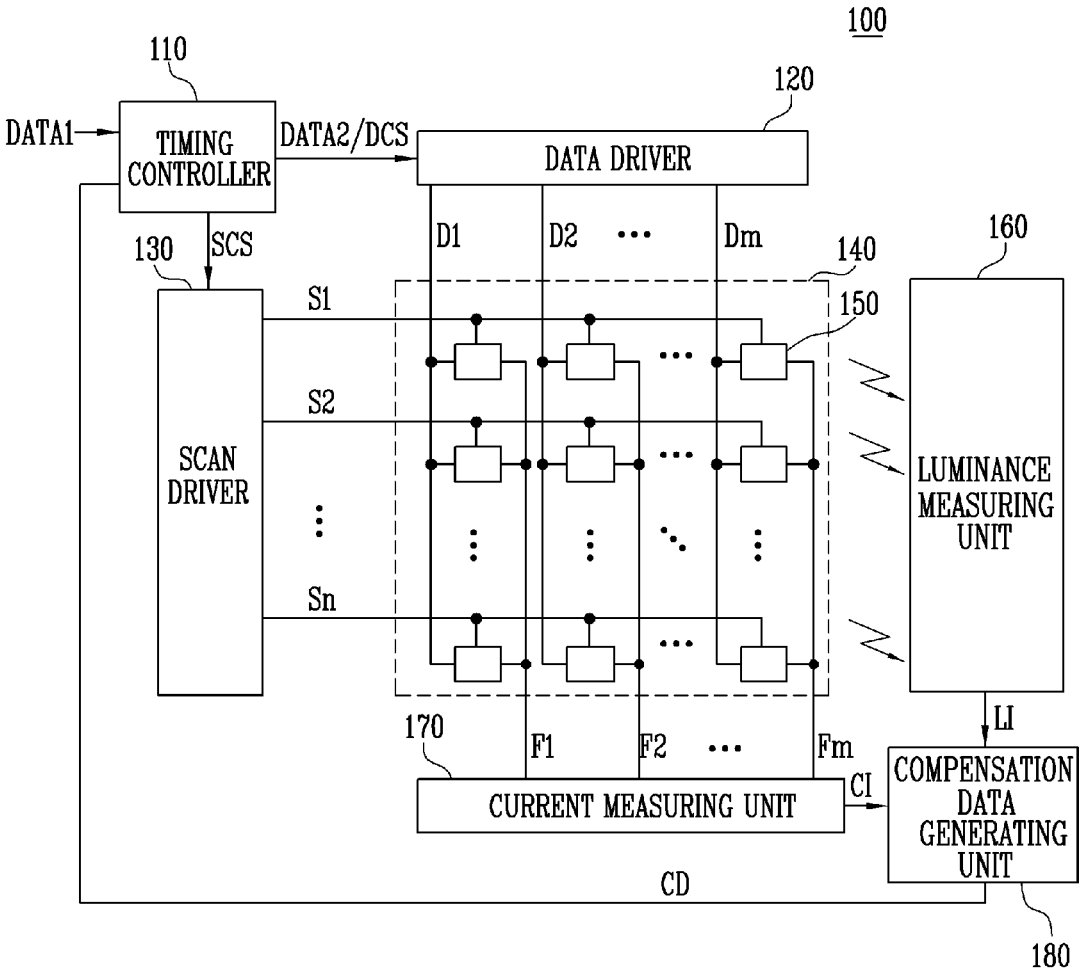
FIG. 1 is a block diagram illustrating an OLED display according to an embodiment.

Hereinafter, certain exemplary embodiments will be described with reference to the accompanying drawings. Here, when a first element is described as being coupled or connected to a second element, the first element may be not only directly coupled or connected to the second element but may also be indirectly coupled or connected to the second element via a third element. Further, some elements that are not essential to the complete understanding of the described technology have been omitted for clarity. Also, like reference numerals refer to like elements throughout the specification.

FIG. 1 is a block diagram illustrating an organic light-emitting diode (OLED) display according to an embodiment.

Referring to FIG. 1, the OLED display 100 includes a timing controller 110, a data driver 120, a scan driver 130, a display unit or display panel 140, a luminance measuring unit 160, a current measuring unit 170, and a compensation data generating unit or compensation data generator 180.

The timing controller 110 controls operations of the data driver 120 and the scan driver 130 in response to a synchronization signal (not shown) received from an external source. Specifically, the timing controller 110 generates a data driving control signal DCS and applies the generated data driving control signal DCS to the data driver 120. The timing controller 110 also generates a scan driving control signal SCS and applies the generated scan driving control signal SCS to the scan driver 130.

The timing controller 110 converts first data DATA1 received from the external source into second data DATA2, in response to compensation data CD received from the compensation data generating unit 180. The timing controller 110 applies the converted second data DATA2 to the data driver 120.

The data driver 120 realigns the second data DATA2 received from the timing controller 110 and applies the realigned second data DATA2 as data signals to data lines D1 to Dm in response to the data driving control signal DCS received from the timing controller 110.

The scan driver 130 progressively applies a scan signal to scan lines S1 to Sn in response to the scan driving control signal SCS received from the timing controller 110.

The display unit 140 includes pixels 150 respectively formed at intersections between the data lines D1 to Dm, the scan lines S1 to Sn, and feedback lines F1 to Fm. In the present embodiment, the data lines D1 to Dm and the feedback lines F1 to Fm are arranged substantially vertically and the scan lines S1 to Sn are arranged substantially horizontally.

Each pixel 150 emits light with a luminance corresponding to a data signal received through a corresponding data line from among the data lines D1 to Dm when a scan signal is received through a corresponding scan line from among the scan lines S1 to Sn.

The luminance measuring unit 160 measures the luminance of each pixel 150 and generates luminance information LI corresponding to the measured luminances. The method of measuring the luminance of each pixel 150 can be varied. In some embodiments, the luminance measuring unit 160 may be implemented as a plurality of charged coupled devices (CCDs).

The current measuring unit 170 measures the current received through the feedback lines F1 to Fm from each pixel 150 and generates current information CI corresponding to the measured currents. In this case, the current supplied from each pixel 150 is the current supplied from a driving transistor included in each pixel 150.

Although it has been illustrated in FIG. 1 that the current output from each pixel 150 is supplied to the current measuring unit 170 through the feedback lines F1 to Fm, the described technology is not limited thereto. For example, the current output from each pixel 150 may be supplied to the current measuring unit 170 through the data lines D1 to Dm without the use of feedback lines F1 to Fm.

The compensation data generating unit 180 generates compensation data CD including a compensation value for each pixel 150 based on the luminance information LI received from the luminance measuring unit 160 and the current information CI received from the current measuring unit 170.

Where low gray scale data is applied to the pixels 150 from the data driver 120, the current output from each pixel 150 has a high signal to noise ratio, and thus, the luminance information LI better reflects the characteristics of each pixel 150 than the current information CI. On the other hand, where high gray scale data is applied to the pixels 150 from the data driver 120, it is highly likely that a moire pattern will be displayed, and thus, the current information CI better reflects the characteristic of each pixel 150 than the luminance information LI.

Thus, when low gray scale data is applied to the pixels 150, the compensation data generating unit 180 generates a compensation value based on the luminance information LI. On the other hand, when high gray scale data is applied to the pixels 150, the compensation data generating unit 180 generates a compensation value based on the current information CI.

The functions and operations of the compensation data generating unit 180 will be described in detail with reference to FIGS. 2 to 5.

Figure 2:
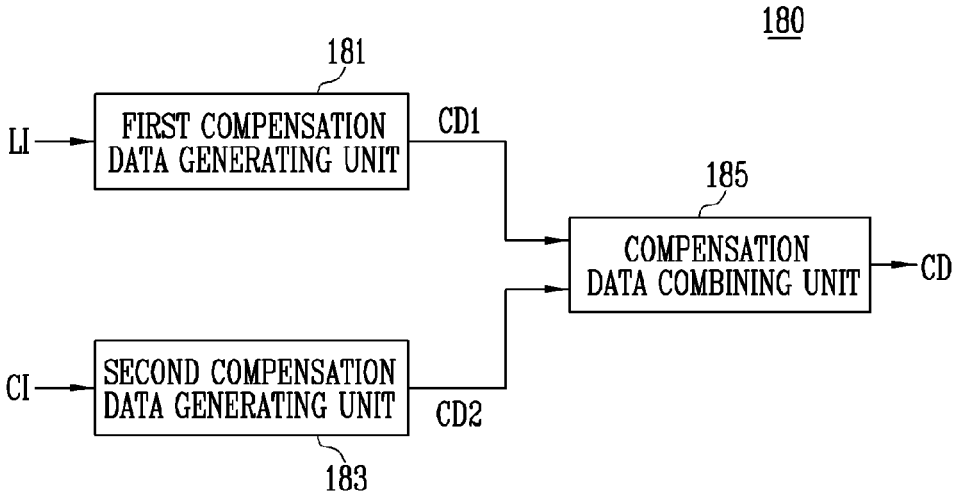
FIG. 2 is a block diagram illustrating the compensation data generating unit shown in FIG. 1 according to a first embodiment.

FIG. 2 is a block diagram illustrating the compensation data generating unit shown in FIG. 1 according to a first embodiment.

Referring to FIG. 2, the compensation data generating unit 180 includes a first compensation data generating unit or first compensation data generator 181, a second compensation data generating unit or second compensation data generator 183 and a compensation data combining unit 185.

The first compensation data generating unit 181 generates first compensation data CD1 based on the luminance information LI received from the luminance measuring unit 160 and outputs the generated first compensation data CD1 to the compensation data combining unit 185.

Figure 5:
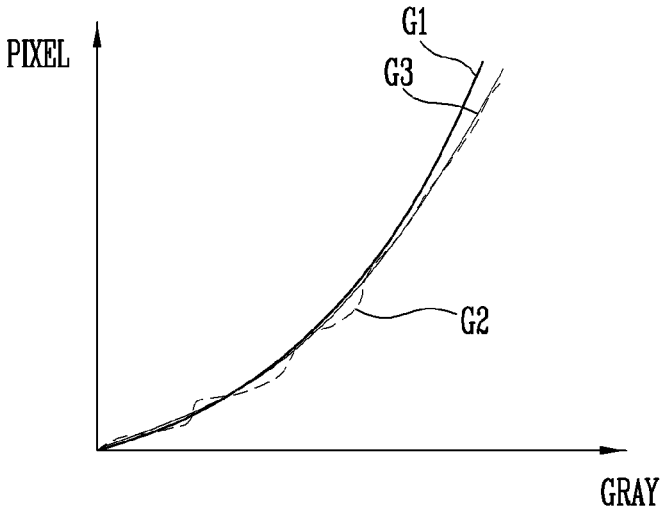
FIG. 5 is a graph illustrating the relationships between current information, luminance information and compensation data.

The first compensation data CD1 may have a shape such as that of the first curve G1 of FIG. 5. Specifically, the first compensation data CD1 precisely reflects the characteristics of each pixel 150 for low gray scales. However, the first compensation data CD1 may not precisely reflect the characteristics of each pixel 150 due to the moire phenomenon for high gray scales.

The second compensation data generating unit 183 generates a second compensation data CD2 based on the current information CI received from the current measuring unit 170 and outputs the generated second compensation data CD2 to the compensation data combining unit 185.

The second compensation data CD2 may have a shape such as that of the second curve G2 of FIG. 5. Specifically, the second compensation data CD2 precisely reflects the characteristics of each pixel 150 for high gray scales. However, the second compensation data CD2 may not precisely reflect the characteristics of each pixel 150 due to noise for low gray scales.

The compensation data combining unit 185 combines the first and second compensation data CD1 and CD2 based on the gray scale of data applied to a corresponding pixel and outputs the combined data as compensation data CD to the timing controller 110.

Figure 3:
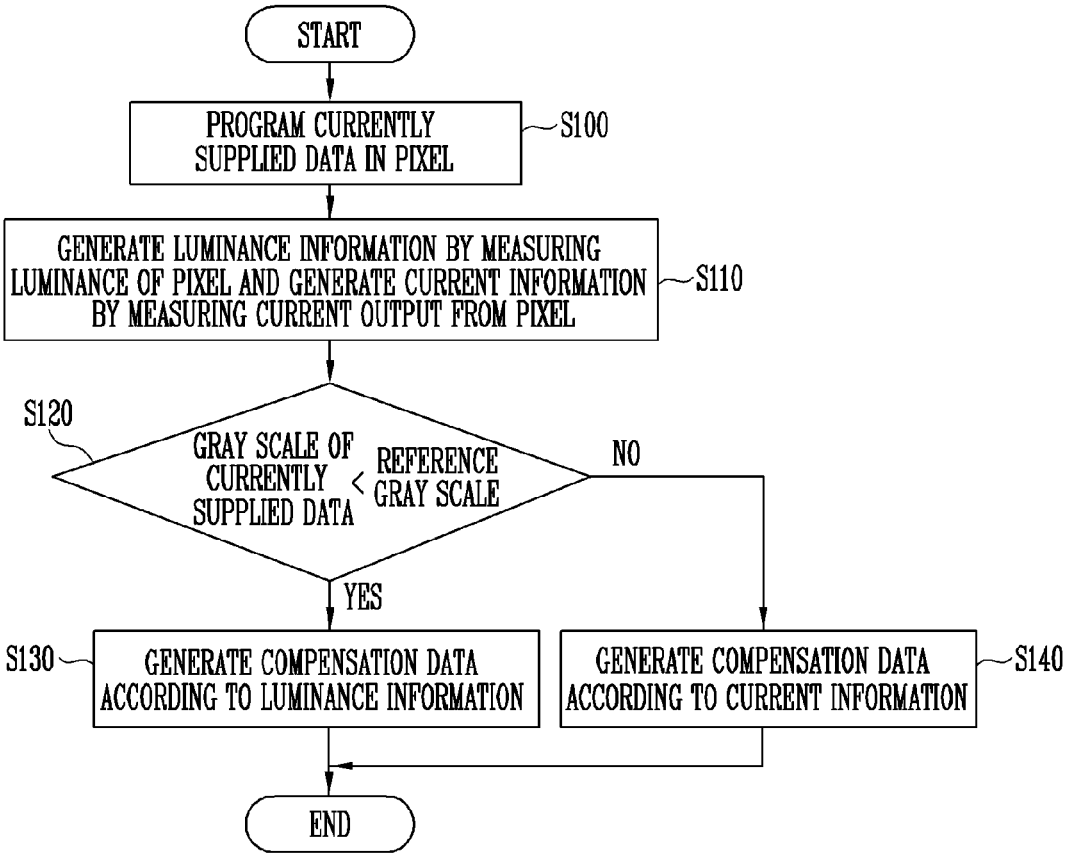
FIG. 3 is a flowchart illustrating the operation of the compensation data generating unit shown in FIG. 1 according to a second embodiment.

FIG. 3 is a flowchart illustrating the operation of the compensation data generating unit shown in FIG. 1 according to a second embodiment.

Referring to FIG. 3, the data driver 120 applies data received from the timing controller 110 to the pixels 150 through the data lines D1 to Dm. A capacitor (not shown) included in each pixel 150 is charged to a voltage corresponding to the data received a corresponding data line D1 to Dm (S100).

When each pixel 150 emits light with the voltage charged in the capacitor, the luminance measuring unit 160 generates luminance information LI by measuring the luminance of each pixel 150. In this case, the current measuring unit 170 generates current information CI by measuring the current output from each pixel 150 (S110).

The compensation data generating unit 180 compares the gray scale of the applied data with a reference gray scale (S120). Here, the reference gray scale may be experimentally determined. Specifically, the gray scale range in which the luminance information LI or the current information CI better reflects the characteristics of the pixels 150 may be changed depending on the structure of the OLED display 100 and the manufacturing process thereof. Thus, a designer may set the reference gray scale based on the structure and manufacturing process of the OLED display 100.

The gray scale range in which the luminance information LI or the current information CI better reflects the characteristics of the pixels 150 may also be changed depending on the driving environment of the OLED display 100. Thus, the reference gray scale can be controlled based on the driving environment, e.g., the temperature or ambient illumination intensity.

When the gray scale of the currently supplied data is less than the reference gray scale, the compensation data generating unit 180 generates compensation data CD based on the luminance information LI (S130). On the other hand, when the gray scale of the currently supplied data is higher than the reference gray scale, the compensation data generating unit 180 generates compensation data CD based on the current information CI.

The compensation data generating unit 180 outputs the generated compensation data CD to the timing controller 110. The timing controller 110 converts first data DATA1 subsequently received from the external source into second data DATA2 based on the compensation data CD output from the compensation data generating unit 180. The timing controller 110 outputs the converted second data DATA2 to the data driver 120.

Figure 4:
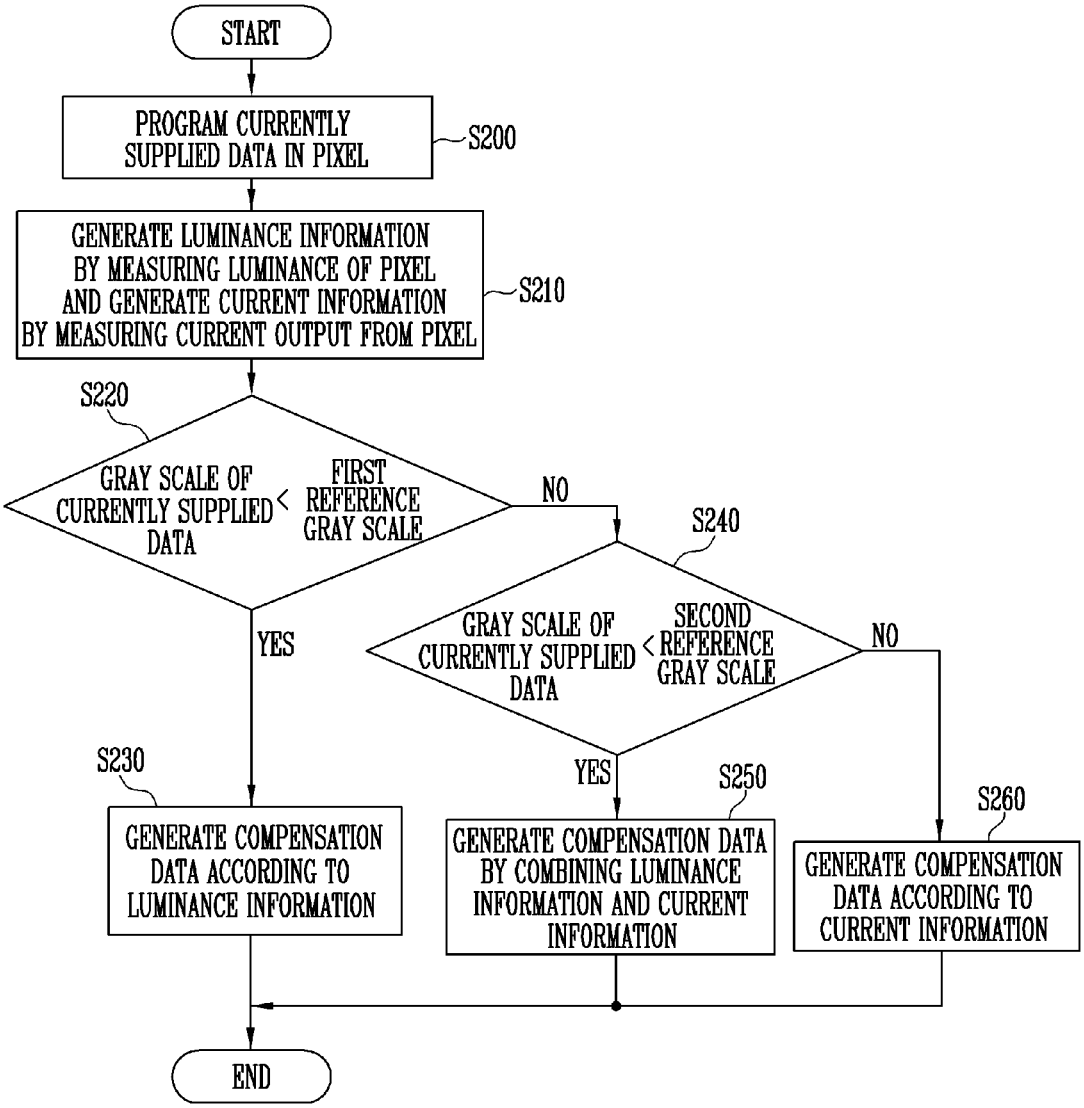
FIG. 4 is a flowchart illustrating the operation of the compensation data generating unit shown in FIG. 1 according to a third embodiment.

FIG. 4 is a flowchart illustrating the operation of the compensation data generating unit shown in FIG. 1 according to a third embodiment.

Referring to FIG. 4, the data driver 120 applies data currently received from the timing controller 110 to the pixels 150 through the data lines D1 to Dm. A capacitor (not shown) included in each pixel 150 is charged to a voltage corresponding to the data received through a corresponding data line D1 to Dm (S200).

When each pixel 150 emits light with the voltage charged in the capacitor, the luminance measuring unit 160 generates luminance information LI by measuring the luminance of each pixel 150. In this case, the current measuring unit 170 generates current information CI by measuring the current output from each pixel 150 (S210).

The compensation data generating unit 180 compares the gray scale of the currently supplied data with a first reference gray scale (S220).

When the gray scale of the currently supplied data is less than the first reference gray scale, the compensation data generating unit 180 generates compensation data CD based on the luminance information LI (S230).

On the other hand, when the gray scale of the currently supplied data is greater than the first reference gray scale, the compensation data generating unit 180 compares the gray scale of the currently supplied data with a second reference gray scale (S240).

When the gray scale of the currently supplied data is less than the second reference gray scale, the compensation data generating unit 180 generates compensation data CD by combining the luminance information LI and the current information CI (S250).

According to some embodiments, when the gray scale of the currently supplied data is greater than the first reference gray scale and less than the second reference gray scale, the compensation data generating unit 180 generates compensation data CD based on the average value of the luminance information LI and the current information CI.

According to other embodiments, when the gray scale of the currently supplied data is greater than the first reference gray scale and less than the second reference gray scale, the compensation data generating unit 180 generates compensation data CD by weighting the luminance information LI and the current information CI with values based on the gray scale of the currently supplied data. For example, when the gray scale of the currently supplied data is closer to the first reference gray scale, the compensation data generating unit 180 may generate the compensation data CD by setting the weighted value of the luminance information LI to be greater than that of the current information CI. On the contrary, when the gray scale of the currently supplied data is closer to the second reference gray scale, the compensation data generating unit 180 may generate the compensation data CD by setting the weighted value of the current information CI to be greater than that of the luminance information LI.

On the other hand, when the gray scale of the currently supplied data is greater than the second reference gray scale, the compensation data generating unit 180 generates compensation data CD based on the current information CI (S260).

Here, the first reference gray scale and the second reference gray scale may be experimentally determined, similar to the reference gray scale in the second embodiment.

The compensation data generating unit 180 outputs the generated compensation data CD to the timing controller 110. The timing controller 110 converts first data DATA1 subsequently received from the external source into a second data DATA2, based on the compensation data CD received from the compensation data generating unit 180, and outputs the converted second data DATA2 to the data driver 120.

FIG. 5 is a graph illustrating the relationships between current information, luminance information and compensation data.

Referring to FIG. 5, the first curve G1 illustrates compensation data generated based on the luminance information LI, e.g., the relationship between gray scale and luminance according to the first compensation data CD1 of the first embodiment. The second curve G2 illustrates compensation data based on the current information CI, e.g., the relationship between gray scale and luminance according to the second compensation data CD2 of the first embodiment. The third curve G3 illustrates the relationship between gray scale and luminance based on the compensation data CD generated by the compensation data generating unit 180.

As shown in the first curve G1 of FIG. 5, the luminance information LI does not precisely reflect the characteristics of each pixel 150 due to the moire phenomenon for high gray scales. As shown in the second curve G2 of FIG. 5, the current information CI does not precisely reflect the characteristics of each pixel 150 due to noise for low gray scales.

Thus, as shown in the third curve G3 of FIG. 5, the compensation data generating unit 180 generates compensation data CD based on the luminance information LI for low gray scales and generates compensation data CD based on the current information CI for high gray scales.

By way of summation and review, the standard OLED display may not display an image with uniform luminance due to the non-uniformity of the threshold voltage/mobility of a driving transistor. In addition, luminance may not be uniform according to the emission efficiency of OLEDs and an image with a desired luminance may not be displayed due to a change in efficiency, caused by the degradation of the OLED.

In the OLED display and the method for driving the same according to the described technology, it is possible to display an image with a substantially uniform luminance.

Example embodiments have been disclosed herein, and although specific terms are employed, they are used and are to be interpreted in a generic and descriptive sense only and not for the purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light-emitting diode (OLED) display, comprising:

a plurality of pixels;

a luminance measuring unit configured to: i) measure luminance of each of the pixels and ii) generate luminance information based at least in part on the measured luminances;

a current measuring unit configured to: i) measure current output from each of the pixels and ii) generate current information based at least in part on the measured currents; and a compensation data generator configured to generate compensation data including a compensation value for each of the pixels based on at least one of the luminance information or the current information, wherein the compensation data generator is further configured to determine whether to use the luminance information or the current information in generating the compensation value for each of the pixels based at least in part on a gray scale of data supplied to the corresponding pixel.

2. The OLED display of claim 1, wherein the compensation data generator is further configured to generate the compensation data based on: i) the luminance information when the gray scale of data supplied to the corresponding pixel is less than a first predetermined reference value and ii) the current information when the gray scale is greater than the first predetermined reference value.

3. The OLED display of claim 2, wherein the compensation data generator is further configured to generate the compensation data based on: i) the luminance information and the current information when the gray scale is between the first predetermined reference value and a second predetermined value and ii) the current information when the gray scale is greater than the second predetermined reference value.

4. The OLED display of claim 3, wherein the compensation data generator is further configured to generate the compensation data based on the average value of the luminance information and the current information when the gray scale is between the first predetermined reference value and the second predetermined reference value.

5. The OLED display of claim 1, wherein the compensation data generator includes:

a first compensation data generator configured to generate first compensation data based at least in part on the luminance information;

a second compensation data generator configured to generate second compensation data based at least in part on the current information; and a compensation data combining unit configured to: i) combine the first and second compensation data based at least in part on the gray scale of data supplied to the corresponding pixel and ii) output the combined data as the compensation data.

6. The OLED display of claim 1, wherein each of the pixels comprises a driving transistor configured to output current to the current measuring unit.

7. The OLED display of claim 1, further comprising a timing controller configured to convert first data received from an external source to second data based at least in part on the compensation data.

8. The OLED display of claim 7, further comprising:

a plurality of data lines; and a data driver configured to: i) convert the second data received from the timing controller into data signals and ii) apply the data signals to the pixels through the data lines.

9. A method of driving an organic light-emitting diode (OLED) display comprising a plurality of pixels, the method comprising:

applying a data signal to each of the pixels;

measuring luminance of each of the pixels;

generating luminance information based at least in part on the measured luminance;

measuring current output from each of the pixels;

generating current information based at least in part on the measured current;

generating compensation data including a compensation value for each of the pixels based on at least one of the luminance information or the current information; and determining whether to use the luminance information or the current information in generating the compensation value for each of the pixels based at least in part on a gray scale of the data signal supplied to the corresponding pixel.

10. The method of claim 9, wherein the generating of the compensation data includes:

comparing the gray scale of the data signal to a first predetermined reference gray scale;

generating the compensation data based on the luminance information when the gray scale is less than the first predetermined reference gray scale; and generating the compensation data based on the current information when the gray scale is greater than the first predetermined reference gray scale.

11. The method of claim 10, wherein the generating of the compensation data includes:

comparing the gray scale of the data signal to a second predetermined reference gray scale;

generating the compensation data based on the average value of the luminance information and the current information when the gray scale is between first predetermined reference gray scale and the second predetermined reference gray scale; and generating the compensation data based on the current information when the gray scale is greater than the second predetermined reference gray scale.

12. The method of claim 9, further comprising:

compensating a next data signal based at least in part on the compensation data; and applying the converted data signal to each of the pixels.

13. An organic light-emitting diode (OLED) display, comprising:

a timing controller configured to receive first data and output second data;

a plurality of pixels, wherein each of the pixels is configured to be driven at a current and display light having a luminance based at least in part on the second data; and a compensation data generator configured to generate compensation data including a compensation value for each of the pixels based on at least one of the current or the luminance of each of the pixels, wherein the timing controller is further configured to generate the second data based at least in part on the first data and the compensation data, and wherein the compensation data generator is further configured to determine whether to use the current or the luminance of each of the pixels in generating the compensation value for each of the pixels based at least in part on a gray scale of data supplied to the corresponding pixel.

14. The OLED display of claim 13, further comprising:

a plurality of data lines; and a data driver configured to: i) convert the second data received from the timing controller into data signals and ii) apply the data signals to the pixels through the data lines.

15. The OLED display of claim 13, further comprising:

a luminance measuring unit configured to measure and provide the luminance of each of the pixels to the compensation data generator; and a current measuring unit configured to measure and provide current output from each of the pixels to the compensation data generator.

16. The OLED display of claim 13, wherein the compensation data generator is further configured to generate the compensation data based on i) the measured luminance when the gray scale of data supplied to the corresponding pixel is less than a first predetermined reference value and ii) the measured current when the gray scale is greater than the first predetermined reference value.

17. The OLED display of claim 16, wherein the compensation data generator is further configured to generate the compensation data based on i) the measured luminance and the measured current when the gray scale is between the first predetermined reference value and a second predetermined value and ii) the measured current when the gray scale is greater than the second predetermined reference value.

18. The OLED display of claim 17, wherein the compensation data generator is further configured to generate the compensation data based on the average value of the measured luminance and the measured current when the gray scale is between the first predetermined reference value and the second predetermined reference value.

19. The OLED display of claim 16, wherein the compensation data generator comprises:

a first compensation data generator configured to generate first compensation data based at least in part on the measured luminance;

a second compensation data generator configured to generate second compensation data based at least in part on the measured current; and a compensation data combining unit configured to: i) combine the first and second compensation data based at least in part on a gray scale of data supplied to a corresponding pixel and ii) output the combined data as the compensation data.

* * * * *